US006085931A

United States Patent [19]

Sadow

[11] Patent Number: 6,085,931

[45] Date of Patent: Jul. 11, 2000

[54] LID ATTACHMENT MEANS FOR TRAVEL MUGS

[76] Inventor: Emily Ann Sadow, 5700 Peppertree Pl., NE., Albuquerque, N. Mex. 87111

[21] Appl. No.: 09/354,679

[22] Filed: Jul. 16, 1999

[51] Int. Cl.[7] ..... B65D 25/04

[52] U.S. Cl. ..... 220/375; 215/306; 220/592.17

[58] Field of Search ..... 220/592.17, 375; 215/306

[56] References Cited

U.S. PATENT DOCUMENTS

| | | | |
|---|---|---|---|
| 1,185,710 | 6/1916 | Perrin | 220/375 |
| 1,611,852 | 12/1926 | Cooper | 220/375 |
| 2,563,202 | 8/1951 | Wurzlow | 220/754 |
| 3,980,202 | 9/1976 | Monyak et al. | 220/375 |
| 4,127,211 | 11/1978 | Zerbey | 220/375 |
| 4,194,657 | 3/1980 | Thor | 220/375 |
| 4,520,926 | 6/1985 | Nelson | 220/375 |
| 5,261,554 | 11/1993 | Forbes | 220/740 |
| 5,758,914 | 6/1998 | Ioveno | 220/375 |
| 5,765,712 | 6/1998 | Skinner et al. | 220/740 |

*Primary Examiner*—Joseph M. Moy
*Attorney, Agent, or Firm*—Thomas N. Neiman

[57] ABSTRACT

The lid attachment means for travel mugs consists of a unit that is designed to overcome the loss of the lids for travel mugs. The lid attachment means consists of a length of string or other material that is looped through a flexible stopper and then is wrapped around the handle of the travel mug and is knotted thereto. A housing is attached to the lid of the travel mug and is designed to receive the string or material. The housing has an openable top portion and base portion and the string or material is inserted therein and then the top portion is closed. The housing is attached to the lid of the travel mug by an adhesive unit.

8 Claims, 1 Drawing Sheet

LID ATTACHMENT MEANS FOR TRAVEL MUGS

BACKGROUND OF THE INVENTION

This invention pertains to travel mugs and, in particular, to a lid attachment means for travel mugs for use in providing a feature to prevent the loss of a lid during transport of the lid and mug when the is not in position on the rim of the mug.

The use of travel mugs is widespread in today's lifestyle. Many people use the for coffee or other beverages as the drive to work, doing the chores, taking the kids to school or activities, etc. The main difficulty with the travel mugs is that the lids or caps get separated from the mug and that makes the travel mug itself, less than a viable device for use in a vehicle. It is also known to use complicated units that make the lid and travel mug a single unit that the lid opens, but does not separate from the mug. What is needed is a device that will maintain the lid for the travel mug in close proximity to the mug and, at the same time, allow the connection device to be removed when the travel mug and lid are being cleaned.

It is the object of this invention to teach a lid attachment means for travel mugs which avoids the disadvantages and limitations, recited above in previous devices to maintaining the lid together with the mug, itself. It is the object of this invention is to provide an apparatus that is inexpensive to manufacture, can be easily attached in position and, at the same time, be very effective.

SUMMARY OF THE INVENTION

Particularly, it is the object of this invention to teach a lid attachment means for travel mugs, for use in providing a feature to prevent the loss of the lid during transport of the lid and mug when the lid is not in position on the rim of the mug comprising a line for connecting said lid and said travel mug; said line having stopper means for attaching said line to the handle of said travel mug; and a receiving housing positioned on said lid for receiving and locking said line in position connecting said lid to said travel mug so that the lid is attached to said travel mug even if it is not positioned on the rim of said travel mug.

It is also the object of this invention to teach a lid attachment means for travel mugs, for use in providing a feature to prevent the loss of the lid during transport of the lid and mug when the lid is not in position on the rim of the mug, comprising in combination first means comprising line for connecting the lid and the travel mug, second means comprising a stopper for attaching said first means to the handle of said travel mug, third means comprising a receiving housing for receiving said first means and connecting said first means to said lid of said travel mug.

BRIEF DESCRIPTION OF THE DRAWINGS

Further objects and features of this invention will become more apparent by reference to the following description taken in conjunction with the following figures, in which.

DETAILED DESCRIPTION OF THE PREFERRED EMBODIMENT

Figure 1:
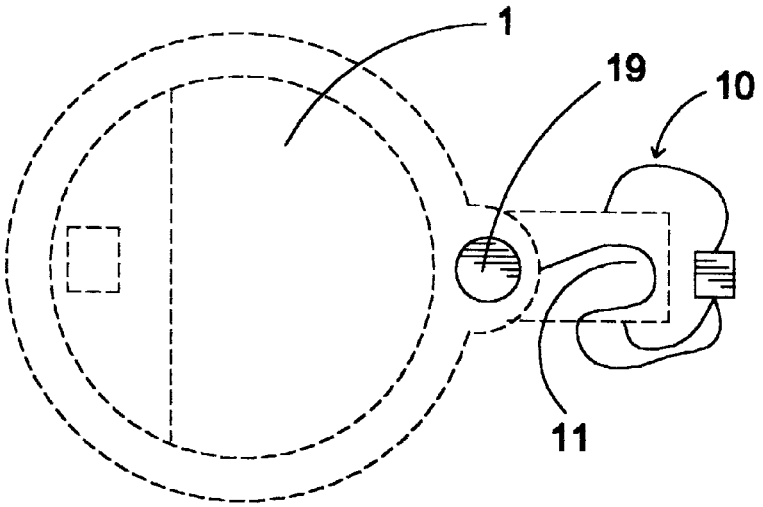
FIG. 1 is a top plan view of the novel lid attachment means for travel mugs.
Figure 2:
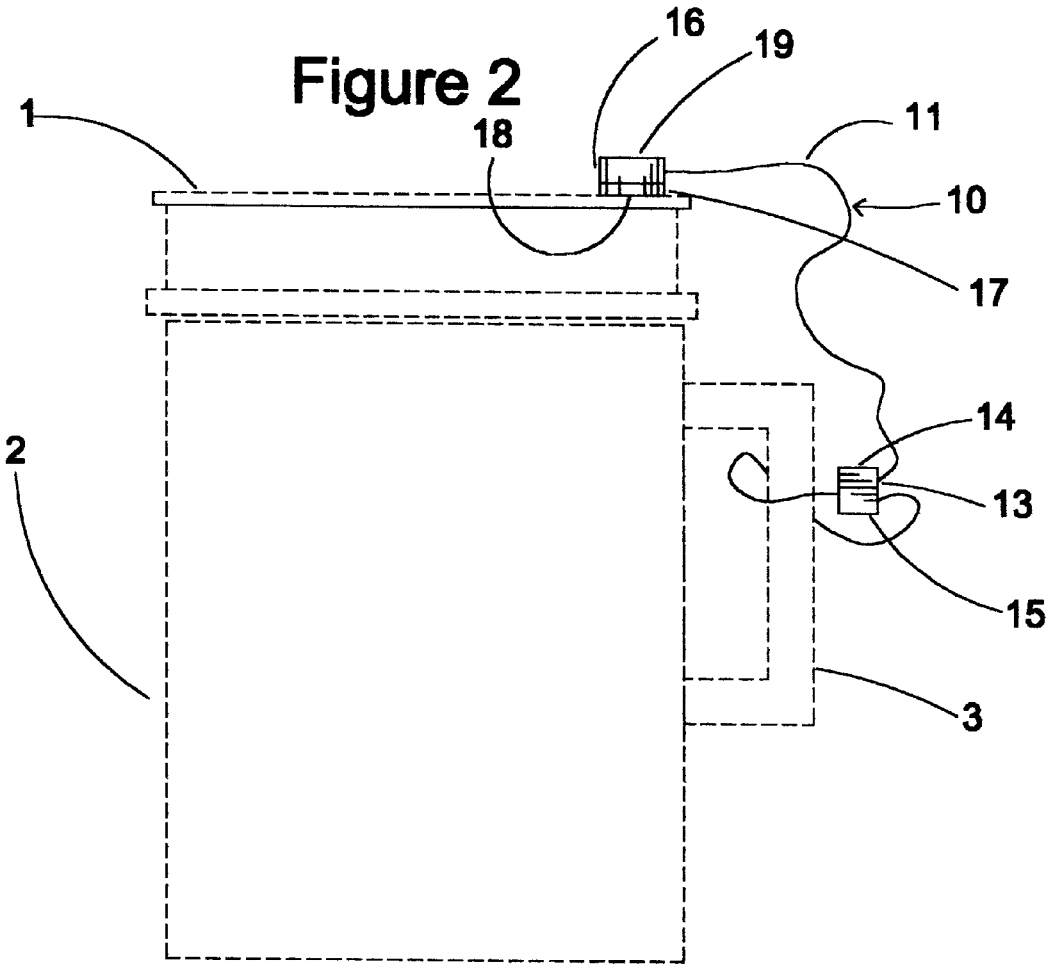
FIG. 2 is a side elevational view thereof, the hatched outlines being for illustrative purposes only.

As shown in the figures, the novel lid attachment means for travel mugs 10 comprises a line or cord of material 11, such as nylon cord, cotton or hemp or the like. The material should be a durable in order to last a long time and, at the same time, be most effective. The line can be colored as desired for decorative purposes. The line or cord 11 is cut to a predetermined length to allow the lid 1 of the travel mug 2 to be removed from the travel mug, but to be in close proximity to the travel mug 2. At the same time, the length of the cord or line 11 should not be excessively long that would create problems of getting in the way or catching things. The line or cord 11 is put through an aperture 13 in a rubber stopper 14 looped around the handle 3 of the travel mug 2 and then through another aperture 15 in the rubber stopper 14 and tied off. This action keeps the line or cord 11 attached to the travel mug 2. A plastic housing 16 having a base section 17 with an adhesive pad 18 on its bottom side is attached to the lid 1 of the travel mug 2. The plastic housing has a top section 19 which opens up. The string or rope 11 is inserted within the open plastic housing 16 and tied off and then the top section is closed to lock off the line or cord 11.

In operation, the user would take a line or cord and pass it through the opening in the rubber stopper and then loop it around the handle of the travel mug. The line or cord is then passed through another aperture and tied off so that the line or cord is permanently attached to the handle of the travel mug. The plastic housing is attached to the lid of the travel mug by means of an adhesive pad located on the bottom of the plastic housing. During manufacture the plastic housing is assembled to allow the line or cord to be inserted and tied off and then close the plastic housing which locks the line and cord. The lid is therefor maintained in close proximity to the travel mug at all times, even when it is not in position on the rim of the travel mug. The assembly is attached to the lid by removal of a paper off the adhesive pad at the base of the plastic housing and positioned on the lid. If the user wishes to put the travel mug in the dishwasher, he or she can untie the line or cord around the handle and have the travel mug and lid washed separately.

While I have described my invention in connection with specific embodiments thereof, it is clearly to be understood that this is done only by way of example and not as a limitation to the scope of my invention as set forth in the objects thereof and in the appended claims.

I claim:

1. A lid attachment means for travel mugs, for use in providing a feature to prevent the loss of the lid during transport of the lid and mug when the lid is not in position on the rim of the mug, comprising:

a line for connecting the lid and the mug;

said line having stopper means for attaching said line to the handle of the mug; and a receiving housing positioned on the lid for receiving and locking said line in position connecting the lid to the mug so that the lid is attached to the mug even if it not positioned on the rim of the mug.

2. A lid attachment means for travel mugs, according to claim 1, wherein:

said line of said lid attachment means for travel mugs comprises a unit of flexible plastic construction.

3. A lid attachment means for travel mugs, according to claim 1, wherein:

said line of said lid attachment means for travel mugs further comprises a unit of cloth construction.

4. A lid attachment means for travel mugs, according to claim 1, wherein:

said stopper means comprises a rubber unit having an aperture therein for receiving said line so that said line can be looped around the handle of the mug and then said line can be reinserted into said aperture and tied off in order for making the connection a permanent connection.

5. A lid attachment means for travel mugs, according to claim 1, wherein:

said receiving housing comprises means for receiving said line;

said receiving housing further comprises a unit an upper and a lower section.

6. A lid attachment means for travel mugs, according to claim 5, wherein:

said receiving housing comprises a unit of rigid construction.

7. A lid attachment means for travel mugs, according to claim 1, wherein;

said receiving housing having attachment means for connecting said receiving housing to the lid; and said lid attachment means comprises the use of adhesive means.

8. A lid attachment means for travel mugs, for use in providing a feature to prevent the loss of the lid during transport of the lid and mug when the lid is not in position on the rim of the mug, comprising in combination:

first means comprising line for connecting the lid and the travel mug, second means comprising a stopper for attaching said first means to the handle of the mug, third means comprising a receiving housing for receiving said first means and connecting said first means to the lid of the travel mug.

* * * * *